United States Patent [19]

Miesterfeld

[11] Patent Number: 4,719,389

[45] Date of Patent: Jan. 12, 1988

[54] METHOD FOR ENERGIZING VACUUM FLUORESCENT DISPLAYS

[75] Inventor: Frederick O. R. Miesterfeld, Troy, Mich.

[73] Assignee: Chrysler Motors Corporation, Highland Park, Mich.

[21] Appl. No.: 812,473

[22] Filed: Dec. 23, 1985

[51] Int. Cl.[4] ..... H05B 37/00

[52] U.S. Cl. ..... 315/169.1; 315/169.4; 340/74; 340/77; 340/79; 340/766; 340/781; 340/789; 340/803; 340/825.22

[58] Field of Search ..... 315/169.1, 169.3, 169.4; 340/781, 789, 803, 814, 825.22, 661, 813, 767, 74, 77, 79, 766, 811, 105

[56] References Cited

U.S. PATENT DOCUMENTS

| | | | |
|---|---|---|---|
| 4,209,729 | 6/1980 | McElroy | 315/169.1 |
| 4,241,278 | 12/1980 | Walther | 315/169.1 |
| 4,241,294 | 12/1980 | Fisler | 315/169.1 |
| 4,476,466 | 10/1984 | Mitani et al. | 340/811 |
| 4,495,445 | 1/1985 | Turney | 315/169.1 |
| 4,570,151 | 2/1986 | Martorano et al. | 340/781 |
| 4,622,843 | 11/1986 | Hormel | 33/356 |
| 4,677,754 | 7/1987 | Hormel | 33/356 |
| 4,682,146 | 7/1987 | Friedman, III | 340/105 |

OTHER PUBLICATIONS

Itron Vacuum Fluorescent Display 128×128 Dot Matrix Graphic Display, by Tsuyoshi Suzuki (SAE 810169), Feb. 1981.

Planar Vacuum Fluorescent Displays, by Kiyoshi Morimoto (SAE 810078), Feb. 1981.

Trend in Vacuum Fluorescent Displays, by Morimoto and Pykosz (SAE 820264), Feb. 1982.

Switching Power Supply Design for Automotive Instrumentation, by Steven K. Kirkman (SAE 820109), Feb. 1982.

High Efficiency Low Cost Vacuum Fluorescent Display Power Supply, by F. Miesterfeld (SAE 830046), Feb. 1983.

*Primary Examiner*—David K. Moore
*Assistant Examiner*—Michael J. Nickerson
*Attorney, Agent, or Firm*—Mark P. Calcaterra

[57] ABSTRACT

A microcomputer controls the energization of both a transformer and display latch driver in a power supply for a vacuum fluorescent display to prevent display flashing at power down. Also provided is the synchronization of the filament voltage to the grid voltage to prevent display pulsations.

5 Claims, 4 Drawing Figures

—Prior Art—

METHOD FOR ENERGIZING VACUUM FLUORESCENT DISPLAYS

BACKGROUND AND SUMMARY OF THE INVENTION

The present invention deals with a design of a vacuum fluorescent display power supply with a regulated display voltage and a regulated power for the filaments.

The approach taken was to use a pulse width modulated power supply as described in SAE Paper 830046, "High Efficiency Low Cost Vacuum Fluorescent Display Power Supply", authored by the inventor.

The improvement presented with the subject invention is to reduce the cost of the system by eliminating the regulator integrated circuit and utilize power from a microcomputer employed for other purposes in the environment of an instrument panel of an automobile.

It is an object of the subject invention to provide a pulse width modulation switching regulator employing a microcomputer to present a minimum pulse width signal to some comparator means such as a software controlled Analog-to-Digital (A/D) converter.

It is a further object of the present invention to employ some comparator means such as a software controlled A/D converter to read the result of a filtered pulse width signal and compare it to a reference and send a signal to the microcomputer to increase the pulse width by one increment if the input is less than the reference.

It is another object of the present invention to employ the same A/D converter or comparator means to read the result of a filtered input pulse width signal and compare it to a reference signal, and to cause the microcomputer to decrease the pulse width by one increment if the input to the A/D converter is greater than the reference signal.

It is still a further object of the subject invention to monitor the filtered pulse width and stabilize it around a reference signal such that the vacuum fluorescent display power supply output voltage is regulated.

DESCRIPTION OF THE DRAWINGS

Other objects, features and advantages of the present invention will become more fully apparent from the following detailed description of the preferred embodiment, the appended claims and in the accompanying drawings in which:

DETAILED DESCRIPTION OF THE PREFERRED EMBODIMENT

There are several types of vacuum fluorescent displays.

A dot matrix type is described in SAE Paper #810169, "Itron Vacuum Fluorescent Display 128×128 Dot Matrix Graphic Display" by Tsuyoshi Suzuki dated February 1981 and is hereby incorporated by reference.

A planar vacuum fluorescent display is described in SAE Paper #810078, "Planar Vacuum Fluorescent Displays" by Kiyoshi Morimoto dated February 1981 and is hereby incorporated by reference.

An overview of such displays is presented in SAE Paper #820264, "Trend in Vacuum Fluorescent Displays" by Kiyoshi Morimoto and Thomas L. Pykosz dated February 1982 and is hereby incorporated by reference.

Power supplies for vacuum fluorescent displays are described in SAE Paper #820109, "Switching Power Supply for Automotive Instrumentation" by Steven K. Kirkman dated February 1982 and is also hereby incorporated by reference.

Figure 1:
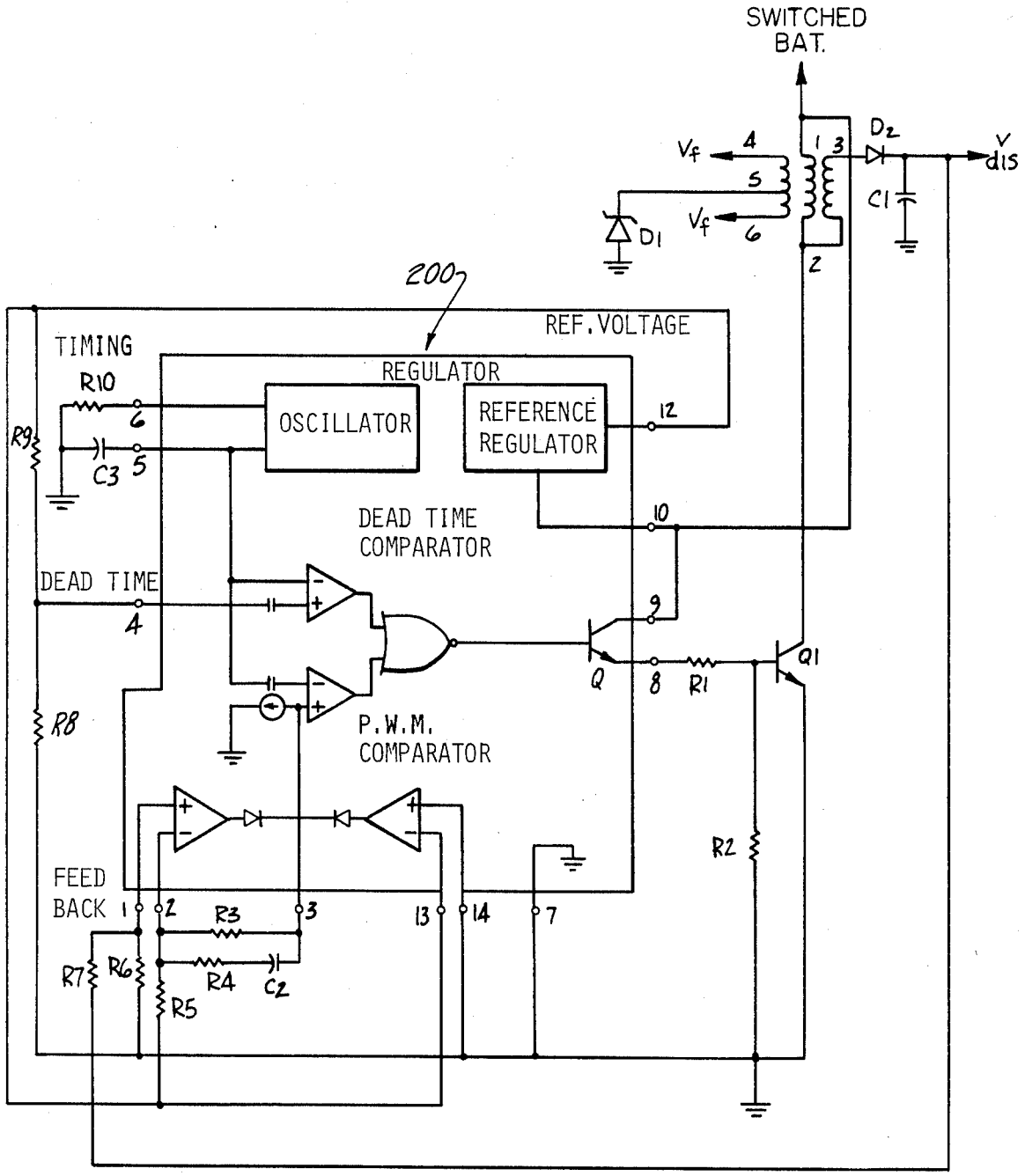
FIG. 1 is a schematic diagram of a vacuum fluorescent display power supply illustrative of the prior art.

Referring to FIG. 1, a schematic diagram is shown of a vacuum fluorescent display power supply which preceded the circuit of the subject invention. This circuit is more fully referred and described in SAE Paper No. 830046, "High Efficiency Low Cost Vacuum Fluorescent Display Power Supply", authored by the inventor and hereby incorporated by reference.

The circuit in FIG. 1 employs a voltage regulator 200 as a control circuit. The voltage regulator 200 employs an oscillator as tuned by timing resistor R10 and capacitor C3. The oscillator feeds the signal to a dead-time comparator, comparing its signal to a dead-time signal presented to pin 4 of voltage regulator 200. The dead-time signal taken from the midpoint of resistor divider network R9 and R8 with R9 being connected to the reference voltage, then in series with R8 which is, in turn, connected to ground. The reference voltage is generated by the reference regulator section of voltage regulator 200 and fed back to the resistor divider network R9/R8. The reference regulator section receives its power from the battery through pin 10 of voltage regulator 200.

Presented to the pulse width modulator comparator of voltage regulator 200 is a feedback signal from the output voltage $V_{dis}$ presented to the pulse width modulator comparator through a feedback network comprising resistors R7 and R6 and presented to pin 1 of the voltage regulator 200.

Also presented to the comparator is the reference voltage through resistor R5 and the parallel combination of resistor R3 in parallel with the series combination of resistor R4 and capacitor C2, the parallel combination being connected across pins 2 and 3 of the voltage regulator 200.

Figure 2:
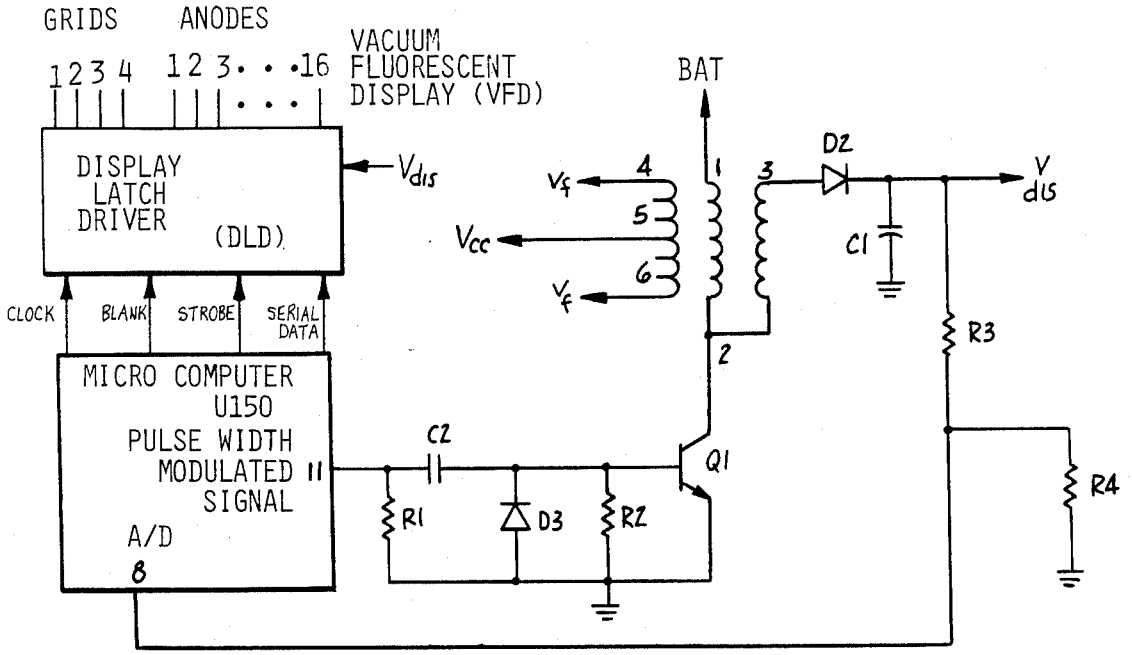
FIG. 2 is a schematic diagram of a vacuum fluorescent display power supply according to the subject invention.

The output of the dead-time comparator in the voltage regulator 200 is presented to a transistor Q on the output of the voltage regulator 200 driving a transistor Q1 external to the voltage regulator 200 which, in turn, switches the power delivered to the pin 2 of the transformer driving th display as shown in the figure. Further, bias is provided by Zener diode D1 on the filament side of the secondary. Diode D2, in conjunction with capacitor C1 on the voltage display side of the secondary, provides the display voltage $V_{dis}$ to a display driver (not shown) for the voltage to the grid of the vacuum fluorescent display (not shown). In FIG. 2 the center tap is shown as able to provide a $V_{CC}$ voltage to circuitry external to the vacuum fluorescent display.

A goal of the subject invention is to reduce the reliance on the voltage regulator 200 and replace it by a method of monitoring and regulating the pulse width without use of a customized or an off-the-shelf integrated circuit. This will be accomplished by utilizing the intelligence of a microcomputer which is already employed at various phases throughout the instrument panel of an instrument cluster of an automobile. Through the use of a microcomputer, the internal software or hardware can replace the function of the pulse width modulator.

Referring now to FIG. 2, the vacuum fluorescent display power supply circuit is shown according to the subject invention where the voltage regulator 200 is eliminated.

FIG. 2 shows a microcomputer U150 in the place of the voltage regulator 200 shown in FIG. 1. The intelligence of the microcomputer U150 allows for the generation of a pulse width modulated signal on pin 11. In addition, pin 8 is available for receiving a signal and presenting the signal to the A/D converter internal to the microcomputer U150. The A/D converter, in conjunction with the software also held internal to the microcomputer, acts as a comparator means for the signal received through resistor R3 from the voltage $V_{dis}$.

Pin 11 is connected to a switching control circuit comprising capacitor C2, connected between pin 11 and the base of transistor Q1, and diode D3 and resistor R2 connected between the base of transistor Q1 and ground. Also available is resistor R1 connected between pin 11 and ground. In turn, the emitter of transistor Q1 is connected to ground and the collector is connected to the transformer as previously described in conjunction with FIG. 1.

Differences in the circuit shown in FIG. 2 versus the circuit shown in FIG. 1 also include the use of resistor R3 connected between pin 8 of the microcomputer U150 and the voltage $V_{dis}$ at the cathode of diode D2 (the voltage to the display latch driver DLD.) Connected between pin 8 of the microcomputer U150 and ground is resistor R4. The resistors R3 and R4 work in conjunction with the microcomputer U150 to allow the microcomputer U150 to compare signals from the DLD to reference signals stored in the memory of U150. The resistors R3 and R4 also work in conjunction with the capacitor C1 and diode D2 to dissipate voltages stored in capacitor C1 after the transformer is turned off by microcomputer U150.

A significant difference exists between the circuitry shown in FIG. 1 and the circuitry shown in FIG. 2. In the circuitry shown in FIG. 1, the voltage regulator receives its power from the switched battery voltage through the transformer. Therefore, when the switched battery voltage is turned off by the operator of the vehicle by turning the ignition key to the "off" position, the transformer is shut down, as well as the voltage regulator 200. This condition results in the voltage regulator 200 shutting down the voltage to the display. At this point, the voltage which has built up on capacitor C1 will possibly generate enough voltage to the display to generate a flash of light visible to the operator of the vehicle. This being objectionable, other systems have employed microcomputers instead of voltage regulators to control the voltage to the display, but all of the known systems have controlled the voltage to the display without controlling the power to the transformer. The subject invention shown in FIG. 2 shows a transformer connected to the battery at all times and a microcomputer U150 controlling the power to the transformer, as well as to the display latch drivers (DLD). This is a significant advance.

More specifically, systems without this scheme have to employ elaborate methods to prevent flashing on the vacuum fluorescent display (VFD) subsequent to the termination of the switched battery voltage. Some systems, immediately after the turn off of the switched battery voltage, drive all of the characters on the VFD to blanks and hold them on. Other systems provide a bypass or shunt transistor to help drain off the voltage left on capacitor C1. Still others hold the DLD on until the voltage on C1 is discharged in response to the termination of the switched battery voltage.

In the subject invention shown in FIG. 2 and further described herein, the transformer is not shut off by the switched battery voltage and the microcomputer U150 stops charging capacitor C1 after the microcomputer senses the termination of the switched battery voltage (not shown), but prior to shutting off the voltage to the DLD $V_{dis}$. In this way, the charge left on capacitor C1 can dissipate through resistors R3 and R4 without creating the flashes on the display panel. The microcomputer U150 has control of how the C1 capacitor voltage is discharged and allows it to drain off at times distinct from the occurrence of the termination of the switched battery voltage.

Transformers of the prior art are merely shut off by an external switch, but in the present invention, control is provided by the microcomputer U150 such that there is an orderly control of the transformer and DLD.

Another important advantage of the structure shown in FIG. 2 and further illustrated in subsequent timing diagrams and flowcharts is the synchronization of the filament voltage $V_F$ to the grid voltage of the VFD. This synchronization eliminates any pulsating or beating of the VFD characters and signals.

The microcomputer U150 controls the VFD, not only by controlling the DC voltage $V_{dis}$ through the above described circuitry and software, but also the voltage supplied to the VFD devices. This is done through an integrated circuit called a display latch driver (DLD) which is shown in FIG. 2. The microcomputer U150 provides clock, blanking, stroke and serial data information to the DLD for control of the VFD devices.

The DLD supplies the required voltages to the grids or anodes shown in FIG. 2 based on the blanking signal from the microcomputer U150. When the appropriate blanking signal is received, serial data from the microcomputer U150 is distributed to the appropriate anodes and grids as will be more fully described in conjunction with the timing diagram in FIG. 4.

Systems of the prior art use the voltage supplied to the filament which is $V_F$ which has the amplitude of the battery voltage and is function of the battery voltage. Therefore, the $V_F$ is not symmetrical, is very unpredictable and has the same signature as that of the battery voltage. The result of this filament voltage being tied to the signature of the battery voltage is that a variable number of pulse width signals to the voltage display will be generated. This results in a difference in the average DC level applied to the filaments, since when a particular grid is supplied with voltage, the number of pulse widths being supplied to the display drivers for that particular grid is not constant. This results in a pulsating or beating of the display.

The synchronization of the filament voltage, such that occurs in a predictable and synchronized manner, ensures that the same number of pulse widths sent to the VFD will occur upon each energization signal to the grid. This results in a steady VFD output.

Figure 3:
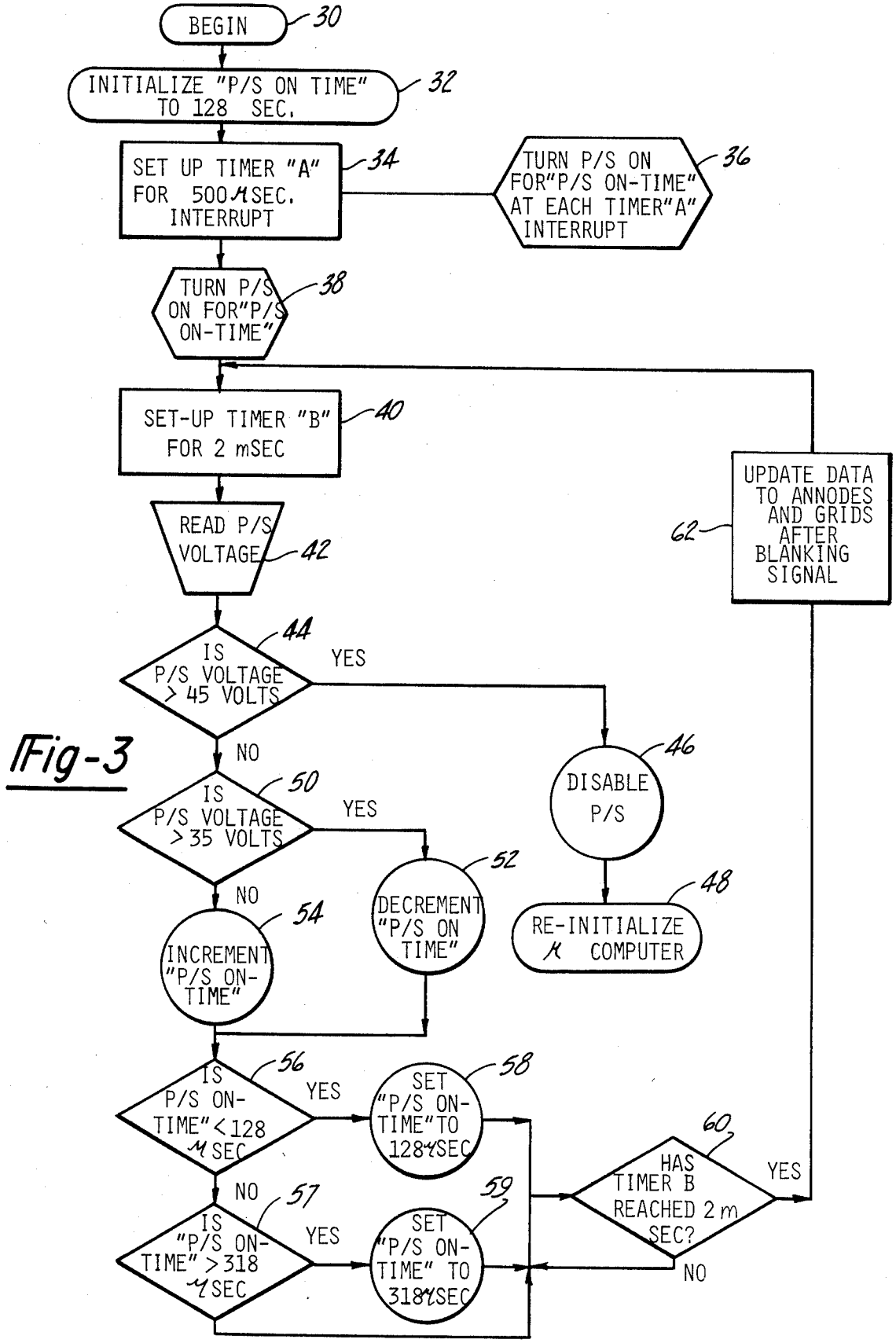
FIG. 3 is a flowchart illustrating a method claimed in the subject invention.
Figure 4:
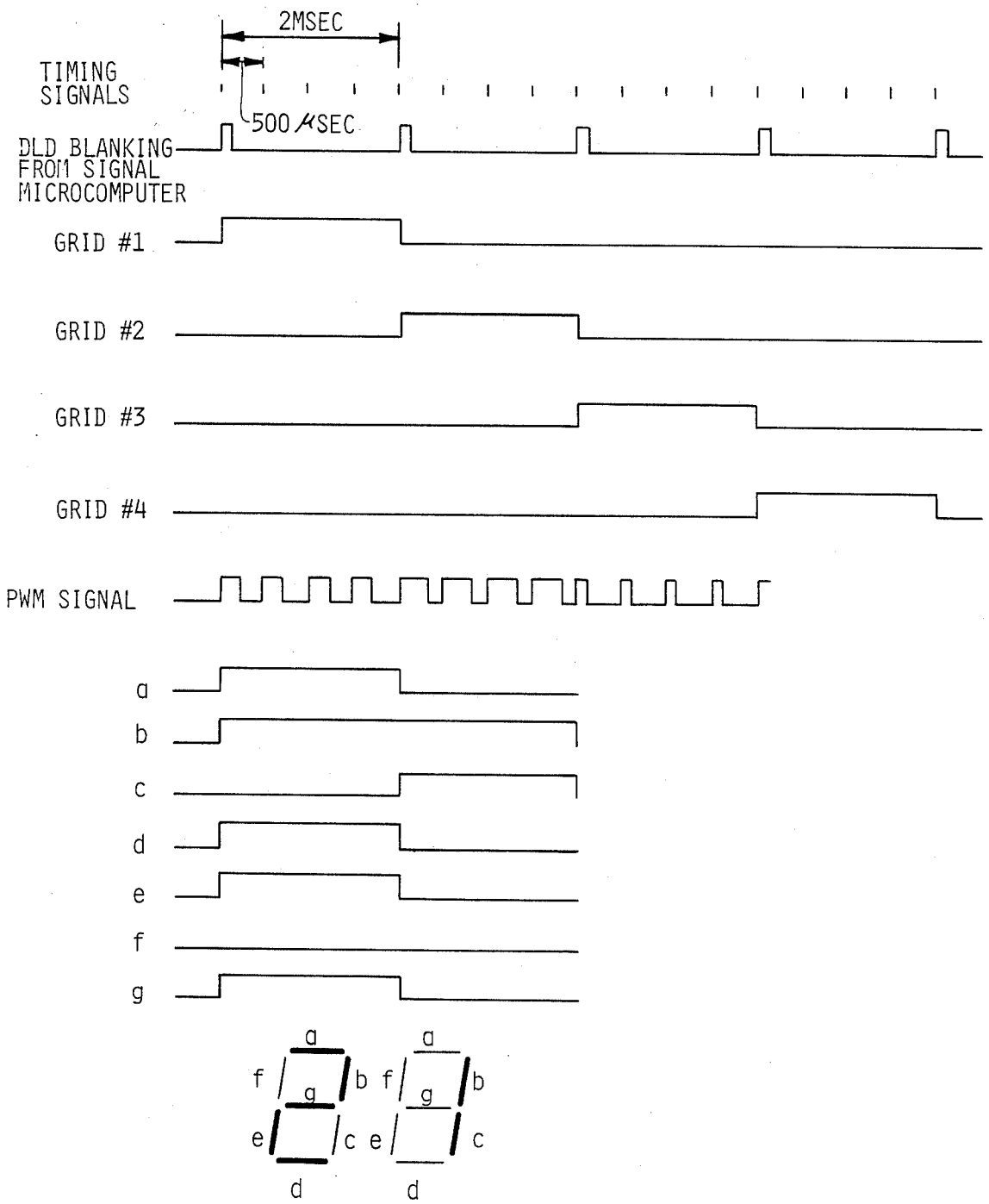
FIG. 4 is a timing diagram showing how the hardware and software interrelate to provide a pulse width signal synchronized to the grid signals.

Referring now to FIG. 4, a timing diagram is presented showing the interrelationship between the signals as processed by the microcomputer U150, in conjunction with the DLD and the software explained in FIG. 3 below. At the top of the figure is a timing axis representing the time periods of 500 microseconds and 2 milliseconds, respectively. Both of these time periods are clocked in the techniques described with respect to FIG. 3 below.

Next is shown the blanking signal from the microprocessor to the DLD. This signal occurs once every 2 milliseconds and is about a 40 microsecond pulse.

Next are the signals to the four grids of the VFD used in the subject invention. Note that the number of VFD grids and anodes is variable depending on the design as is the addressing order of the grids. In other words, each grid is individually addressed by a signal given to it in a 2-millisecond time frame. If the particular grid associated with the vacuum fluorescent display device is to be excited for more than a 2-millisecond time period, the signal would remain high for the desired duration.

Next, in FIG. 4 is shown the pulse width modulated (PWM) signal shown with three different pulse widths. This illustrates what the PWM signal would look like in a reference condition during the first 2-millisecond period, in an incremented condition during the second 2-millisecond period and in a decremented condition in the third 2-millisecond period.

Lastly, in FIG. 4, the specific anodes within the vacuum fluorescent display are shown after being driven to display the characters "21." Note that the example is in the form of a 7-segment character. Each segment is individually labeled from "a" through "g." The corresponding segments for each character are commonly tied together. Therefore, all of the anodes with the designation "a" are tied together, etc.

In the example as shown in FIG. 4, the character corresponding to grid 1 during the first 2-millisecond time period was driven to display the numeral "2" by pulsing a signal to the anodes labeled "a", "b", "d", "e", "g." Similarly, the character associated with grid 2 was driven to display the numeral "1", in the second 2-millisecond time period, by driving the anodes designated "b" and "c" to a high level and returning the others to a low level.

Note that this is just an example to illustrate how the individual vacuum fluorescent devices can be addressed to display any combination of characters and messages.

Referring now to FIG. 3, illustrated is a flowchart showing the method according to the subject invention interrelating it to the schematic in FIG. 2. The microcomputer begins in bubble 30 when called upon to use the switching regulator method.

The first step is to initialize a variable; in this case we will call it, "P/S ON-TIME" standing for Power Supply On-Time. This variable will be initialized to 128 microseconds, an empirically derived time period, for the purposes of the subject display which finds itself in the instrument panel of an automobile. This represents the on-time or the duration of a high level in the PWM signal.

The method then proceeds to block 34 to set up a timer for a 500 microsecond interrupt. In this case, we will call the timer we are setting up, "A." This means that after each 500 microsecond time period, the power supply will be turned on for the P/S ON-TIME by sending the pulse width modulated signal shown in FIG. 4 to the transformer from pin 11 of microcomputer U150.

The method then proceeds after setting up timer A in block 34 to block 38 to initially turn on the power supply for the P/S ON-TIME. This is the initial turn-on of the power supply and it will be for 128 microseconds as initialized in block 32 or for any other time period as selected by the designer for that particular application.

The method then proceeds to block 40 to set up another timer, only this time for a two-millisecond time period. We will call this timer, "timer B." Unlike timer A, timer B is not used on an interrupt basis, but as part of the timed loop of the whole method. Other embodiments are possible; utilizing counter instead of timers, for example.

The method then proceeds to block 42 and reads the power supply voltage which is presented to the display. This voltage can be read on pin 8 of the microcomputer and $V_{dis}$ as stepped down by R3 and R4.

The method then proceeds to block 44 to check the power supply voltage read in block 42 and compare it to a 45-volt level. If the power supply voltage is greater than 45 volts, the power supply is then disabled in block 46 and the microprocessor or microcomputer U150 is re-initialized in block 48. This condition represents an over-voltage situation which could damage the system. The disabling occurs to protect the system.

Returning now to block 44, if the power supply voltage is not greater than 45 volts, the method falls through to block 50 for another comparison. This time the comparison is centered around 35 volts. If the power supply voltage is greater than 35 volts, the method branches to block 52 and decrements the variable P/S ON-TIME to change the pulse width modulated signal shown in FIG. 4.

Returning to decision block 50, if the power supply voltage is not greater than 35 volts, the method falls through to block 54 to increment the variable P/S ON-TIME which changes the pulse width modulated signal shown in FIG. 4 for the next use of that variable by the microcomputer in the interrupt loop caused by timer A.

Regardless of whether the P/S voltage was incremented in block 52 or incremented in block 54, the method next falls through to decision block 56 to check the status of the variable P/S ON-TIME. If the variable P/S ON-TIME is less than 128 microseconds, the method branches to block 58 and sets the variable P/S ONTIME equal to 128 microseconds. This is a design choice and is a function of the particular design. In this case, it has been determined that 128 microseconds is the minimum on-time for the pulse width signal acquired for optimum performance.

Returning now to decision block 56, if the power supply on-time variable is not less than 128 microseconds, the method falls through to another decision block 57 to again check the power supply on-time, but this time to check to see whether the variable is greater than 318 microseconds. This is an upper limit and, again, is a design choice based upon the particular circumstances—the environment of the design and the hardware selected. The 318 microseconds represents the maximum power supply on-time for this particular embodiment. If the variable P/S ON-TIME is greater than 318 microseconds, then the method branches to block 59 to set the P/S ON-TIME to 318 microseconds as a cap.

If the variable P/S ON-TIME as checked in decision block 57 is not greater than 318 microseconds, the variable must be between the values of 128 microseconds and 318 microseconds and the method then proceeds to the same point that bubble 58 and 59 proceed if those branches are reached, that is to decision block 60.

Decision block 60 calls for a check of timer B to see whether it has reached its set-up time of two milliseconds. This occurs once every four interrupts by timer A per block 36. The display is then updated in block 62 by updating the data to the anodes and grids of the VFD after each blanking signal. The method then returns to block 40 to set up the timer B again for a two-millisecond time period and repeat the process as indicated in the flowchart. If timer B has not reached its two-millisecond time period, then the method calls for the microcomputer to wait, rechecking the status of timer B until the two-millisecond time period has been reached. Obviously, this is occurring as the microcomputer is available and as interrupted per block 36 by the expiration of the 500 microsecond time period set up in timer A in block 34.

While the present invention has been disclosed in connection with the preferred embodiment thereof, it should be understood that there may be other embodiments which fall within the spirit and scope of the invention and that the invention is susceptible to modification, variation and change without departing from the proper scope or fair meaning of the following claims.

I claim:

1. A method of controlling a power supply for a vacuum fluorescent display to regulate voltage to the display, the method being implemented in an electronic circuit with a display driver, and a microcomputer with timer means and comparator means, the steps comprising:

initializing a first variable corresponding to the minimum amount of on-time the power supply is to be energized;

setting up a first timer for an interrupt and turning on the power supply for the time period specified in the first variable each time the first timer forces an interrupt of the method;

turning the power supply on for the time period indicated in the first variable;

setting up a second timer for a second time period;

reading the power supply voltage;

comparing the power supply voltage to a maximum amount of voltage acceptable for the particular design;

comparing the power supply voltage to a minimum amount of acceptable. voltage if the maximum amount of voltage is not exceeded;

decrementing the first variable corresponding to the power supply on-time if the power supply voltage is greater than the minimum amount;

incrementing the first variable corresponding to the power supply on-time if the power supply voltage is less than a minimum amount;

checking to see whether the first variable, corresponding to the power supply on-time, is less than a minimum amount;

setting the first variable corresponding to the power supply on-time to the minimum amount if the variable is below it as read;

checking the first variable corresponding to the power supply on-time against a maximum amount if the minimum amount was exceeded;

setting the first variable corresponding to the power supply on-time to the maximum amount if the first variable as read exceeded the maximum;

checking the condition of the second timer, to see if the second timer has reached the second time period, after the condition of the first variable corresponding to the power supply on-time has been set;

waiting for the second timer to reach the second time period;

updating data to the vacuum fluorescent display after blanking the display;

returning to set up the second timer for the second time period, if the second timer has reached its second period limit.

2. The method of controlling a power supply for a vacuum fluorescent display in claim 1 further comprising:

disabling the power supply if the power supply voltage exceeds the maximum amount.

3. The method of controlling a power supply for a vacuum fluorescent display in claim 2 further comprising:

re-initializing the microcomputer after disabling the power supply.

4. The method of claim 1 further comprising:

supplying a pulse width modulated signal from the output of the microcomputer to turn on the power supply.

5. The method of claim 3 further comprising:

synchronizing the pulse width modulated signal to the updating of the data to the vacuum fluorescent display.

* * * * *